US010325702B2

(12) United States Patent
Tsang et al.

(10) Patent No.: US 10,325,702 B2
(45) Date of Patent: Jun. 18, 2019

(54) STRUCTURALLY RESILIENT POSITIVE TEMPERATURE COEFFICIENT MATERIAL AND METHOD FOR MAKING SAME

(71) Applicant: LITTELFUSE, INC., Chicago, IL (US)

(72) Inventors: Chun-Kwan Tsang, Morgan Hill, CA (US); Jianhua Chen, Sunnyvale, CA (US)

(73) Assignee: LITTELFUSE, INC., Chicago, IL (US)

( * ) Notice: Subject to any disclaimer, the term of this patent is extended or adjusted under 35 U.S.C. 154(b) by 158 days.

(21) Appl. No.: 15/168,546

(22) Filed: May 31, 2016

(65) Prior Publication Data

US 2017/0345533 A1 Nov. 30, 2017

(51) Int. Cl.

| | |
|---|---|
| ***H01C 7/02*** | (2006.01) |
| ***H01C 7/00*** | (2006.01) |
| ***H01C 17/06*** | (2006.01) |

(52) U.S. Cl.

CPC ..... *H01C 7/02* (2013.01); *H01C 7/008* (2013.01); *H01C 7/027* (2013.01); *H01C 17/06* (2013.01)

(58) Field of Classification Search

CPC ..... H01C 7/02; H01C 17/06; H01C 7/008
USPC ..... 338/22 R
See application file for complete search history.

(56) References Cited

U.S. PATENT DOCUMENTS

| | | | | |
|---|---|---|---|---|
| 4,126,560 | A * | 11/1978 | Marcus | B01D 39/10 210/489 |
| 4,314,231 | A * | 2/1982 | Walty | H01C 7/027 338/212 |
| 4,327,351 | A * | 4/1982 | Walker | H01C 1/1406 219/553 |
| 5,742,223 | A * | 4/1998 | Simendinger, III | H01C 7/027 338/20 |
| 2003/0198849 | A1 * | 10/2003 | Hampden-Smith | B01J 21/18 429/483 |

OTHER PUBLICATIONS

ISR and Written Opinion dated Jul. 31, 2017, in corresponding PCT/US2017/031859.

* cited by examiner

*Primary Examiner* — Kyung S Lee
*Assistant Examiner* — Iman Malakooti

(57) ABSTRACT

Structurally supported positive temperature coefficient (PTC) materials are disclosed. Furthermore, methods to provide structurally supported PTC materials are disclosed. In one implementation, a structurally supported PTC material includes a support structure that is at least partially covered by a PTC material. In one example, the support structure is a mesh material integrated at least partially in the PTC material.

20 Claims, 4 Drawing Sheets

STRUCTURALLY RESILIENT POSITIVE TEMPERATURE COEFFICIENT MATERIAL AND METHOD FOR MAKING SAME

BACKGROUND

Field

The present invention relates generally to positive temperature coefficient (PTC) materials and relates more particularly to a structurally resilient PTC material.

Description of Related Art

Positive temperature coefficient (PTC) devices are typically utilized in circuits to provide protection against over current conditions. PTC material in the PTC device is selected to have a relatively low resistance within a normal operating temperature range of the PTC device, and a high resistance above the normal operating temperature of the PTC device.

For example, a PTC device may be placed in series with a battery terminal so that all the current flowing through the battery flows through the PTC device. The temperature of the PTC device gradually increases as current flowing through the PTC device increases. When the temperature of the PTC device reaches an "activation temperature," the resistance of the PTC device increases sharply. This in turn significantly reduces the current flow through the PTC device to thereby protect the battery from an overcurrent condition. In another example, a PTC device may be structured as a surface mount resettable fuse. The PTC resettable fuse may have two conductors or leads that couple to a printed circuit board (PCB) or the like. The PTC resettable fuse is designed to protect against damage causable by harmful overcurrent surges and overtemperature faults.

Existing PTC devices normally include a core material having PTC characteristics (i.e., the PTC material). Such PTC devices may be surrounded by a package that comprises a barrier/insulation material. Conductive pads, layers or leads may be electrically coupled to opposite surfaces of the PTC material so that current flows through a cross-section of the PTC material.

At normal temperature, conductive properties of the PTC material of existing PTC devices form low-resistance networks. However, if the temperature rises, either from high current through the PTC device or from an increase in the ambient temperature, the PTC material may melt or soften and become amorphous. This softening or melting of the PTC material disrupts the conductive properties of the PTC material, but also reduces the rigidity of existing PTC devices. A reduction in the rigidity of existing PTC devices, either from high current or from an increase in ambient temperature, may negatively affect the functionality of existing PTC devices implemented in an arrangement that applies compression forces on the existing PTC devices.

Other problems with existing PTC devices will become apparent in view of the disclosure below.

SUMMARY

Structurally resilient positive temperature coefficient (PTC) materials are disclosed herein. Furthermore, methods to provide structurally resilient PTC materials are disclosed herein.

In one implementation, a PTC material may include an internal support structure, where the PTC material at least partially covers the support structure. In a particular implementation, the internal support structure is a mesh that is at least partially covered by a PTC material.

In another implementation, a method provides a PTC material that includes an internal support structure. The method includes at least partially covering a support structure with a PTC material. In a particular implementation, the support structure is a mesh, and the method includes at least partially covering the mesh with a PTC material.

DETAILED DESCRIPTION

Structurally supported positive temperature coefficient (PTC) materials are disclosed herein. Furthermore, methods to provide structurally supported PTC materials are disclosed herein. In one implementation, a structurally supported PTC material includes a support structure that is at least partially covered by a PTC material. In one example, the support structure is a mesh or lattice material. In another example, the support structure is at least one spacer material that includes a plurality of through holes, apertures, or through ways. In another example, the support structure is a plurality of single hole spacers. The holes or through ways of the aforementioned support structure materials may be square shaped, circular shaped, rectangle shaped, tetrahedral shaped, pyramidal shaped, triangular shaped, hexagon shaped, or the like.

Figure 1:
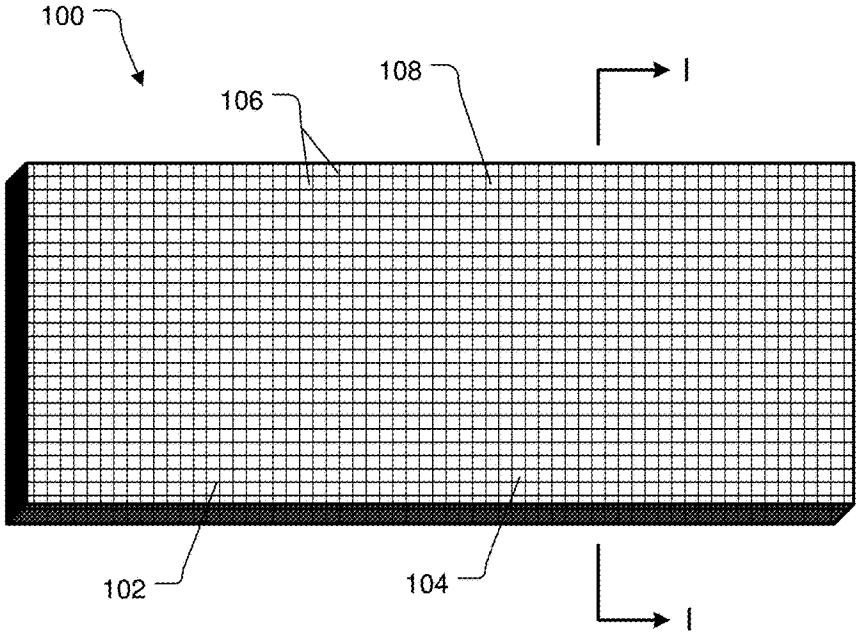
FIG. 1 illustrates an implementation of a structurally supported positive temperature coefficient (PTC).

FIG. 1 illustrates an implementation of a structurally supported PTC material 100. The structurally supported PTC material 100 includes PTC material 102 that at least partially covers a support structure 104. At least partially covering the support structure 104 with the PTC material 102 provides at least a partially integrated structure. That is, the PTC material 102 may at least partially cover top and bottom surfaces of the support structure 104. In the example shown in FIG. 1, the support structure 104 is a mesh or lattice material. The support structure 104 may include strands 106 that define the mesh or lattice material of the support structure 104. More particularly, the strands 106 of the support structure 104 define a plurality of holes or apertures 108 of the support structure 104. The support structure 104 may alternatively be at least one spacer material (see FIG. 3) that includes a plurality of through holes, apertures or through ways, or the support structure 104 may be structured from a plurality of single hole spacers. The holes or through ways of the aforementioned support structure materials may be square shaped, circular shaped, rectangle shaped, tetrahedral shaped, pyramidal shaped, triangular shaped, hexagon shaped, or the like. The support structure 104 may alternatively have a different size and/or shape than illustrated and described herein. The structurally supported PTC material 100 illustrated in FIG. 1 is shown as a sheet or film. However, the structurally supported PTC material 100 may be provided in other shapes and sizes than that illustrated in FIG. 1.

The PTC material 102 may include one or more conductive and polymer fillers. The conductive filler may include conductive particles of tungsten carbide, nickel, carbon, titanium carbide, or a different conductive filler or different materials having similar conductive characteristics. The polymer filler may include particles of polyvinylidene difluoride, polyethylene, ethylene tetrafluoroethylene, ethylene-vinyl acetate, ethylene butyl acrylate or different materials having similar characteristics. Furthermore, the PTC material 100 to may comprise a plurality of layers that include unique conductive and polymer fillers.

The support structure 104 may be an electrically nonconductive material. For example, the support structure 104 may be glass, Kevlar, polymer, ceramic, carbon fiber, insulated metal, fabric, or the like. In another implementation, the support structure 104 may include electrically conductive material. For example, the support structure 104 may be glass, Kevlar, polymer, ceramic, carbon fiber, fabric, or the like, that includes one or more electrically conductive material disposed therein. The one or more electrically conductive material may include one or more of tungsten carbide, nickel, carbon, titanium carbide, or a different conductive material. Alternatively, the support structure 104 may be an electrically conductive material, such as silver, copper, gold, aluminum, stainless steel, or the like. In one example, one or more of the strands 106 of the support structure 104 may comprise electrically conductive material and others of the one or more strands 106 may comprise electrically nonconductive material and/or only electrically nonconductive material. Similarly, as discussed in the foregoing, the support structure 104 may comprise at least one spacer material (see FIG. 3) that includes a plurality of through holes, apertures or through ways, or the support structure 104 may be structured from a plurality of single hole spacers. The spacers defining the support structure 104 may comprise electrically conductive material and/or electrically nonconductive material.

The strands 106 of the support structure 104 may have a diameter of approximately 50 μm. However, the diameter of the strands 106 may be less than or greater than 50 μm. The apertures 108 of the support structure 104 may have a width and/or length of at least 115 μm. In one example, at least one of the apertures 108 is defined by an opening of 115×145 μm. The size of the apertures 108 may be less than or greater than 115 μm. In one particular implementation, the support structure 104 has a material free open area of approximately 55% and a thermal stability of approximately 250° C. Therefore, in one implementation, the support structure 104 resists melting, softening, and the like up to approximately 250° C. In one implementation, the support structure 104 is inert to organic solvents. Furthermore, the support structure 104 may have a compression strength capable of tolerating a force of approximately 150 kg/cm$^2$. In particular, the support structure 104 may be structurally stable up to at least a force of approximately 150 kg/cm$^2$. Therefore, the support structure 104 resists cracking, breaking, deformation, or the like up to at least a force of approximately 150 kg/cm$^2$. The support structure 104 may have a compression strength capable of tolerating a force of less than or greater than 150 kg/cm$^2$.

Figure 2:
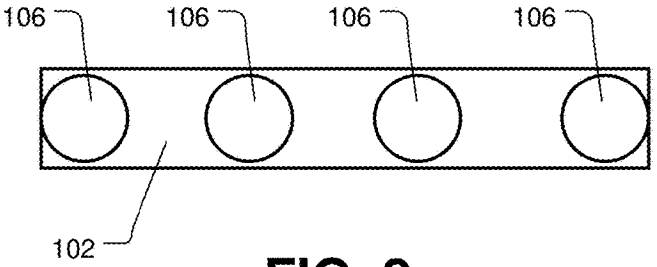
FIG. 2 illustrates a cross-section view of a structurally supported PTC material, as viewed from the perspective of line I-I shown in FIG. 1.

FIG. 2 illustrates a cross-section view of the structurally supported PTC material 100, as viewed from the perspective of line I-I shown in FIG. 1. As is illustrated, the PTC material 102 at least partially covers one or more of the strands 106 associated with the support structure 104. Specifically, the PTC material 102 may not completely cover each of the strands 106. For example, an upper portion of one or more of the strands 106 may not be completely covered by the PTC material 102. Moreover, lower and/or side portions of the PTC material 102 may not be completely covered by the PTC material 102. In one example, the PTC material 102 completely covers all of the strands 106 or a majority of the strands 106. The strands 106 illustrated in FIG. 2 have a cross-section that is circular. However, other cross-sectional shapes, such as square or rectangle, may be associated with the strands 106.

Figure 3:
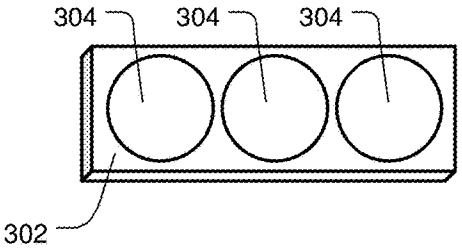
FIG. 3 illustrates an exemplary support structure that may be used to provide structural stability in a PTC material.

FIG. 3 illustrates an exemplary support structure 302 that may be used to provide structural stability in the PTC material 102. The support structure 302 is an example of a spacer material that includes a plurality of through holes, apertures or through ways 304. The support structure 302 is shown as having three apertures 304. However, the illustrated number of apertures 304 is purely exemplary. The support structure 302 may be provided as a sheet or film that includes many of the apertures 304. Such a sheet or film may be integrated with the PTC material 102 to provide structural stability for the PTC material 102. Alternatively, multiple separate support structures 302 may be combined together and integrated with the PTC material 102 to provide structural stability.

Figure 4:
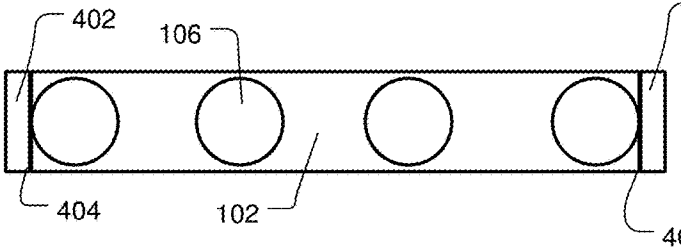
FIG. 4 illustrates another cross-section view of the structurally supported PTC material, as viewed from the perspective of line I-I shown in FIG. 1.

FIG. 4 illustrates another cross-section view of the structurally supported PTC material 100, as viewed from the perspective of line I-I shown in FIG. 1. As is illustrated, the PTC material 102 at least partially covers one or more of the strands 106 associated with the support structure 104. In this embodiment, at least one electrically conductive layer 402 is applied over a first surface 404 of the PTC material 100. In the figure, the electrically conductive layer 402 is shown as being in contact with the PTC material 102. However, one or more layers may be disposed between the PTC material 102 and the electrically conductive layer 402. In another embodiment, another electrically conductive layer 406 is applied over a second surface 408 of the PTC material 100. In FIG. 4, the electrically conductive layer 406 is shown as being in contact with the PTC material 102. However, one or more layers may be disposed between the PTC material 102 and the electrically conductive layer 406.

Figure 5:
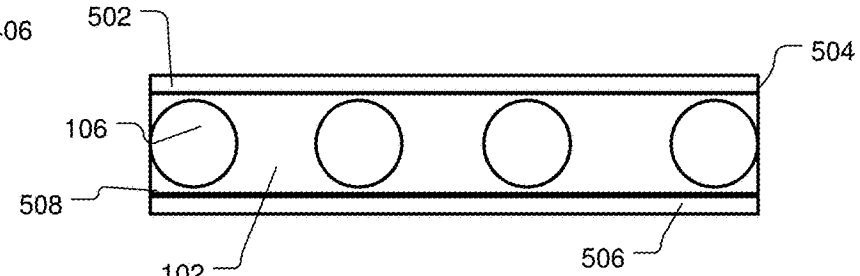
FIG. 5 illustrates yet another cross-section view of the structurally supported PTC material, as viewed from the perspective of line I-I shown in FIG. 1.

FIG. 5 illustrates yet another cross-section view of the structurally supported PTC material 100, as viewed from the perspective of line I-I shown in FIG. 1. As is illustrated, the PTC material 102 at least partially covers one or more of the strands 106 associated with the support structure 104. In this embodiment, at least one electrically conductive layer 502 is applied over a first surface 504 of the PTC material 100. In the figure, the electrically conductive layer 402 is shown as being in contact with the PTC material 102. However, one or more layers may be disposed between the PTC material 102 and the electrically conductive layer 502. In another embodiment, another electrically conductive layer 506 is applied over a second surface 508 of the PTC material 100. In FIG. 5, the electrically conductive layer 506 is shown as being in contact with the PTC material 102. However, one or more layers may be disposed between the PTC material 102 and the electrically conductive layer 506.

Figure 6:
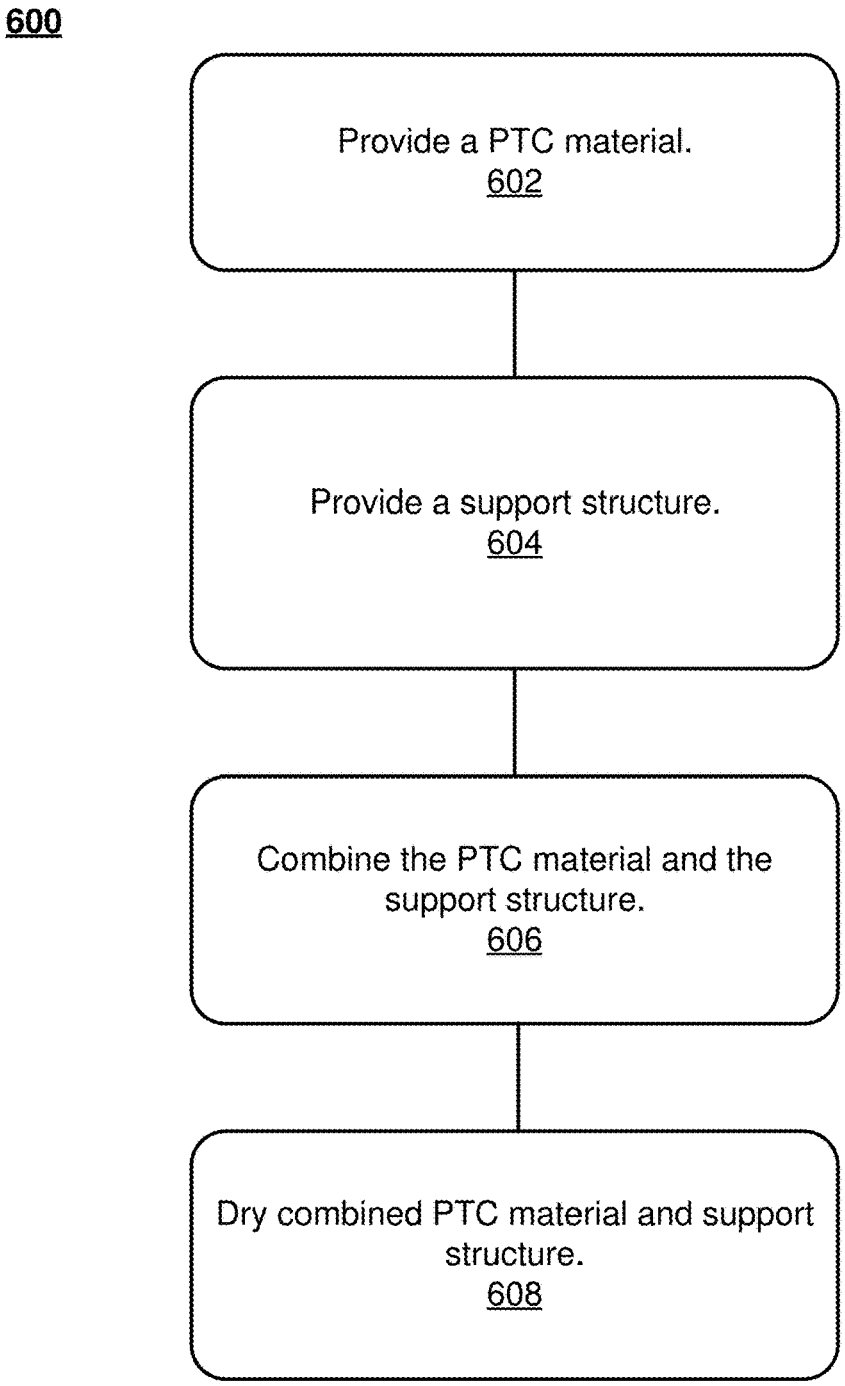
FIG. 6 illustrates an exemplary set of operations for manufacturing a structurally supported PTC material.

FIG. 6 illustrates an exemplary set of operations for manufacturing a structurally supported PTC material. At block 602, a PTC material may be provided in a powdered form. Alternatively, the PTC material may be provided in a liquid form, also known as PTC ink. The PTC material may include one or more conductive and polymer fillers. The conductive filler may include conductive particles of tungsten carbide, nickel, carbon, titanium carbide, or a different conductive filler or different materials having similar conductive characteristics. The polymer filler may include particles of polyvinylidene difluoride, polyethylene, ethylene tetrafluoroethylene, ethylene-vinyl acetate, ethylene butyl acrylate or different materials having similar characteristics.

At block 604, a support structure is provided. In one example, the support structure is a mesh or lattice material. In another example, the support structure is at least one spacer material that includes a plurality of through holes, apertures, or through ways. In another example, the support structure is a plurality of single hole spacers. The holes or through ways of the aforementioned support structure materials may be square shaped, circular shaped, rectangle shaped, tetrahedral shaped, pyramidal shaped, triangular shaped, hexagon shaped, or the like. The support structure may be an electrically nonconductive material. For example, the support structure may be glass, Kevlar, polymer, ceramic, carbon fiber, insulated metal, fabric, or the like. In another implementation, the support structure may include electrically conductive material. For example, the support structure may be glass, Kevlar, polymer, ceramic, carbon fiber, fabric, or the like, that includes one or more electrically conductive material disposed therein. The one or more electrically conductive material may include one or more of tungsten carbide, nickel, carbon, titanium carbide, or a different conductive material. Alternatively, the support structure may be an electrically conductive material, such as silver, copper, gold, aluminum, stainless steel, or the like. In one example, one or more of the strands (e.g., strands 106) of the support structure may comprise electrically conductive material and others of the one or more strands may comprise electrically nonconductive material and/or only electrically nonconductive material. Similarly, as discussed in the foregoing, the support structure may comprise at least one spacer material (see FIG. 3) that includes a plurality of through holes, apertures or through ways, or the support structure may be structured from a plurality of single hole spacers. The spacers defining the support structure may comprise electrically conductive material and/or electrically nonconductive material.

The strands of the support structure may have a diameter of approximately 50 μm. However, the diameter of the strands may be less than or greater than 50 μm. The apertures of the support structure may have a width and/or length of at least 115 μm. In one example, at least one of the apertures is defined by an opening of 115×145 μm. The size of the apertures may be less than or greater than 115 μm. In one particular implementation, the support structure has a material free open area of approximately 55% and a thermal stability of approximately 250° C. In one implementation, the support structure is inert to organic solvents. Furthermore, support the structure may have a compression strength capable of tolerating a force of approximately 150 kg/cm$^2$. The support structure may have a compression strength capable of tolerating a force of less than or greater than 150 kg/cm$^2$.

At block 606, the PTC material and the support structure are combined. In one example, combining the PTC material and the support structure provides at least a partially integrated structure that includes the PTC material and the support structure in the PTC material. In one embodiment, the support structure is placed on a rigid surface, such as a conductive substrate or a plate, and the PTC material is applied over the support structure. PTC material in powdered form may be sprayed over the support structure. PTC material in ink form may also be sprayed over the support structure. Alternatively, PTC material in ink form may be applied over the support structure using an application blade. PTC material in powdered form may be combined with the support structure by way of compression using a press or roll press to achieve a desired thickness of the structurally supported PTC material. PTC material in ink form may be combined with the support structure using an application blade (e.g., Doctor Blade) to achieve a desired thickness of the structurally supported PTC material. In one or more embodiments, the process of combining the PTC material and the support structure may include providing one or more electrically conductive surface over a surface or surfaces of the structurally supported PTC material.

At block 608, the combined PTC material and support structure, which provide the structurally supported PTC material, is allowed to harden by drying. In one implementation, the combined PTC material and support structure are hardened in an oven.

Figure 7:
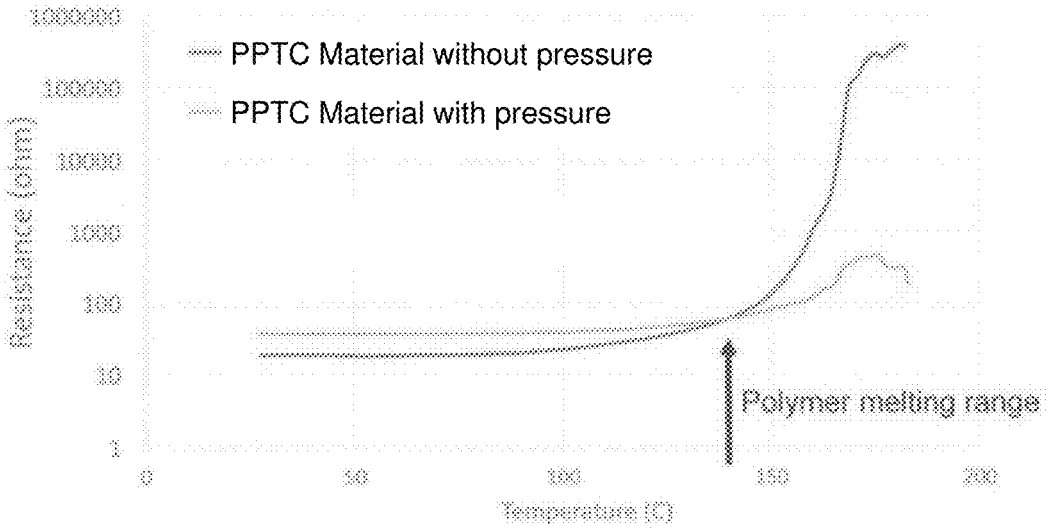
FIG. 7 is a chart that illustrates the operational performance of conventional PTC material without internal structural enhancements.

FIG. 7 is a chart that illustrates conventional polymeric positive coefficient (PPTC) film material performance without structural enhancements. The PPTC film material without pressure exertion thereon exhibits a rapid increase in resistance at and beyond the polymer melting range. This is a proper operating characteristic of the PPTC film material. However, when pressure is applied to the PPTC film material, the PPTC film material may not be able to achieve a proper resistance value at and beyond the polymer melting range of the polymer used in the PTC material.

Figure 8:
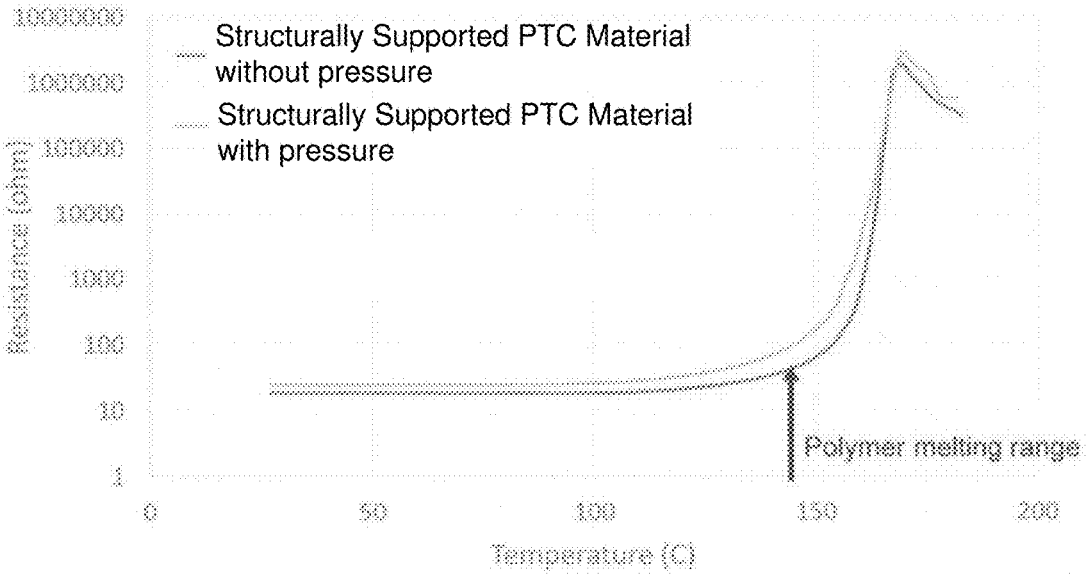
FIG. 8 is a chart that illustrates the operational performance of structurally supported PTC material in accordance with one or more embodiments described herein.

FIG. 8 is a chart that illustrates the operational performance of structurally supported PTC material in accordance with one or more embodiments described herein. In particular, PTC material structurally supported or enhanced according to one or more embodiments described herein is shown to exhibit a rapid increase in resistance at and beyond the polymer melting range, with or without pressure or force applied to the PTC material. Therefore, structurally supported PTC material in accordance with one or more embodiments described herein may be advantageously used in arrangements and/or environments that may be subject to direct or indirect forces.

While structurally enhanced/supported PTC material and a method for manufacturing structurally enhanced/supported PTC material have been described with reference to certain embodiments, it will be understood by those skilled in the art that various changes may be made and equivalents may be substituted without departing from the spirit and scope of the claims of the application. Other modifications may be made to adapt a particular situation or material to the teachings disclosed above without departing from the scope of the claims. Therefore, the claims should not be construed as being limited to any one of the particular embodiments disclosed, but to any embodiments that fall within the scope of the claims.

We claim:

1. An apparatus, comprising:

a support structure formed of a mesh comprising a plurality of strands defining a plurality of apertures; and a positive temperature coefficient (PTC) material covering the support structure such that an entirety of the mesh is embedded within the PTC material with no part of the mesh extending outside of the PTC material to thereby provide the support structure integrated in the PTC material.

2. The apparatus according to claim 1, wherein the support structure comprises a mesh material, a multi-hole spacer, or a plurality of single hole spacers.

3. The apparatus according to claim 1, wherein the support structure comprises at least one of an electrically nonconductive material and an electrically conductive material.

4. The apparatus according to claim 1, wherein the PTC material comprises polymer and conductive particles.

5. The apparatus according to claim 1, wherein the support structure comprises glass, Kevlar, polymer, ceramic, carbon fiber, insulated metal, electrically conductive material or fabric.

6. The apparatus according to claim 1, wherein the PTC material at least partially fills one or more of the plurality of apertures.

7. The apparatus according to claim 6, wherein each of the plurality of strands have a diameter of approximately 50 μm and each of the plurality of apertures has a width of at least 115 μm.

8. The apparatus according to claim 6, wherein the mesh material comprises a free open area of approximately 55% and a thermal stability of approximately 250 degrees Celsius.

9. The apparatus according to claim 1, wherein the support structure is structurally stable up to a force of approximately 150 kg/cm$^2$ and thermally stable up approximately 250 degrees Celsius.

10. The apparatus according to claim 1, wherein the PTC material comprises first and second opposite surfaces, the apparatus further comprising an electrically conductive layer disposed over at least one of the first and second opposite surfaces.

11. A method, comprising:

providing a support structure formed a mesh comprising a plurality of strands defining a plurality of apertures; and at least partially covering the support structure with a positive temperature coefficient (PTC) material such that an entirety of the mesh is embedded within the PTC material with no part of the mesh extending outside of the PTC material to thereby provide the support structure integrated in the PTC material.

12. The method according to claim 11, wherein the support structure comprises a mesh material, a multi-hole spacer, or a plurality of single hole spacers.

13. The method according to claim 11, wherein the support structure comprises at least one of an electrically nonconductive material and an electrically conductive material.

14. The method according to claim 11, wherein the PTC material comprises polymer and conductive particles.

15. The method according to claim 11, wherein the support structure comprises glass, Kevlar, polymer, ceramic, carbon fiber, insulated metal, electrically conductive material or fabric.

16. The method according to claim 11, wherein the PTC material at least partially fills one or more of the plurality of apertures.

17. The method according to claim 16, wherein each of the plurality of strands have a diameter of approximately 50 μm and each of the plurality of apertures has a width of at least 115 μm.

18. The method according to claim 16, wherein the mesh material comprises a free open area of approximately 55% and a thermal stability of approximately 250 degrees Celsius.

19. The method according to claim 11, wherein the support structure is structurally stable up to a force of approximately 150 kg/cm$^2$ and thermally stable up to approximately 250 degrees Celsius.

20. The method according to claim 11, wherein the PTC material comprises first and second opposite surfaces, the method further comprising disposing an electrically conductive layer over at least one of the first and second opposite surfaces.

* * * * *